United States Patent [19]

Highfield

[11] 4,434,110

[45] Feb. 28, 1984

[54] CARBURETOR, CONTROL APPARATUS AND METHOD FOR INTERNAL COMBUSTION ENGINES

[75] Inventor: William Highfield, Sacramento, Calif.

[73] Assignee: Fuel Systems Management, Roseville, Calif.

[21] Appl. No.: 246,402

[22] Filed: Mar. 23, 1981

[51] Int. Cl.[3] ..... F02M 9/12

[52] U.S. Cl. ..... 261/36 A; 261/44 B; 261/44 D; 261/DIG. 19; 261/DIG. 74; 261/DIG. 39; 137/115; 123/325; 55/164

[58] Field of Search ..... 261/44 B, 44 D, DIG. 19, 261/DIG. 74, 36 A, DIG. 39; 137/115; 123/325, 326; 55/160, 164, 170

[56] References Cited

U.S. PATENT DOCUMENTS

| | | | |
|---|---|---|---|
| T986,009 | 9/1979 | Muller | 261/DIG. 19 |
| 1,477,012 | 12/1923 | Simpson | 261/44 B |
| 1,600,294 | 9/1926 | Nice | 261/44 D |
| 1,901,564 | 3/1933 | McCarty | 261/44 D |
| 2,828,116 | 3/1958 | Bascle, Jr. | 261/44 D |
| 3,061,286 | 10/1962 | Mennesson | 261/36 A |
| 3,217,732 | 11/1965 | Haugeland | 137/115 |
| 3,362,694 | 1/1968 | Gould | 55/170 |
| 3,432,152 | 3/1969 | Sweeney | 261/50 A |
| 3,618,581 | 11/1971 | Simonet | 261/DIG. 74 |
| 3,774,628 | 11/1973 | Norton et al. | 137/115 |
| 3,794,003 | 2/1974 | Reddy | 123/325 |
| 3,834,679 | 9/1974 | Baribeau et al. | 261/DIG. 39 |
| 3,866,584 | 2/1975 | Bigalke et al. | 123/325 |
| 3,920,778 | 11/1975 | De Rugeris | 55/170 |
| 3,943,205 | 3/1976 | Oliver | 261/50 R |
| 4,075,988 | 2/1978 | Kato | 261/DIG. 19 |
| 4,083,267 | 4/1978 | Raaz | 123/325 |
| 4,137,284 | 1/1979 | Barbee | 261/44 B |
| 4,156,405 | 5/1979 | Franke | 123/325 |
| 4,206,735 | 6/1980 | Miles et al. | 261/36 A |
| 4,244,334 | 1/1981 | Maisch | 123/325 |
| 4,292,257 | 9/1981 | Knowlton | 261/DIG. 74 |

FOREIGN PATENT DOCUMENTS

| | | | |
|---|---|---|---|
| 2559157 | 8/1976 | Fed. Rep. of Germany | 261/36 A |
| 2705272 | 8/1978 | Fed. Rep. of Germany | 55/164 |

*Primary Examiner*—Tim R. Miles

*Attorney, Agent, or Firm*—Phillips, Moore, Lempio & Finley

[57] ABSTRACT

A carburetor and associated control apparatus for an internal combustion engine. The carburetor includes a carburetor head having a fuel inlet conduit and an air inlet conduit communicating with a fuel mixing chamber. The carburetor further includes metering means for controlling the amount of fuel and air entering the mixing chamber. The mixing chamber connects to an expansion chamber through a control orifice in the carburetor head. The carburetor also includes a carburetor housing having a throat that communicates with the expansion chamber and with an air delivery passage. Air entering the throat is metered with an air valve that is moved with respect to the air delivery passage in correspondence with the fuel metering means.

30 Claims, 7 Drawing Figures

FIGURE 3
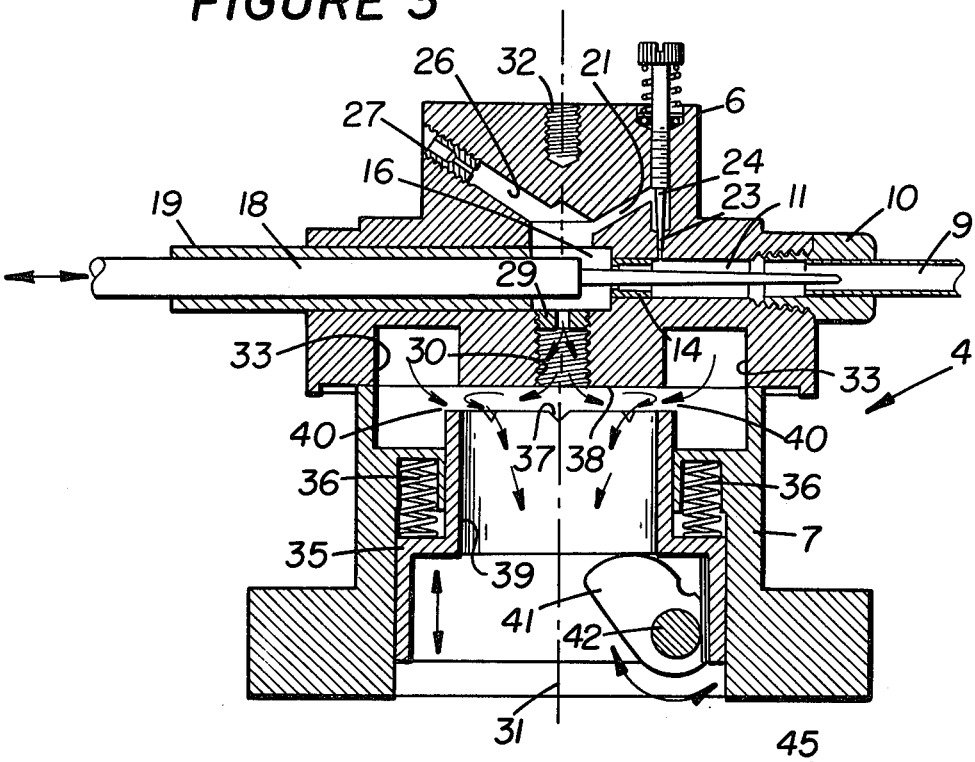
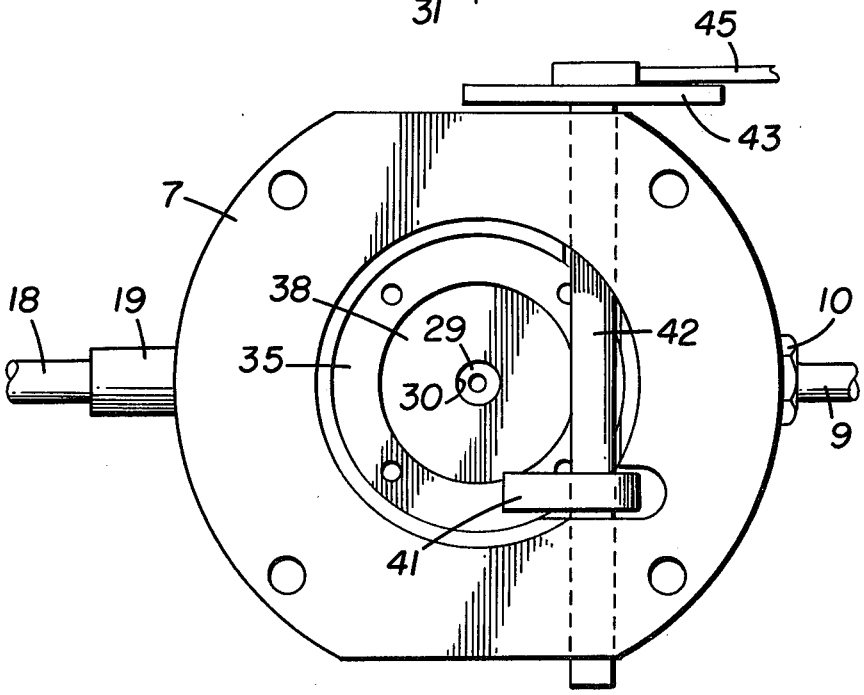
FIGURE 4

FIGURE 5
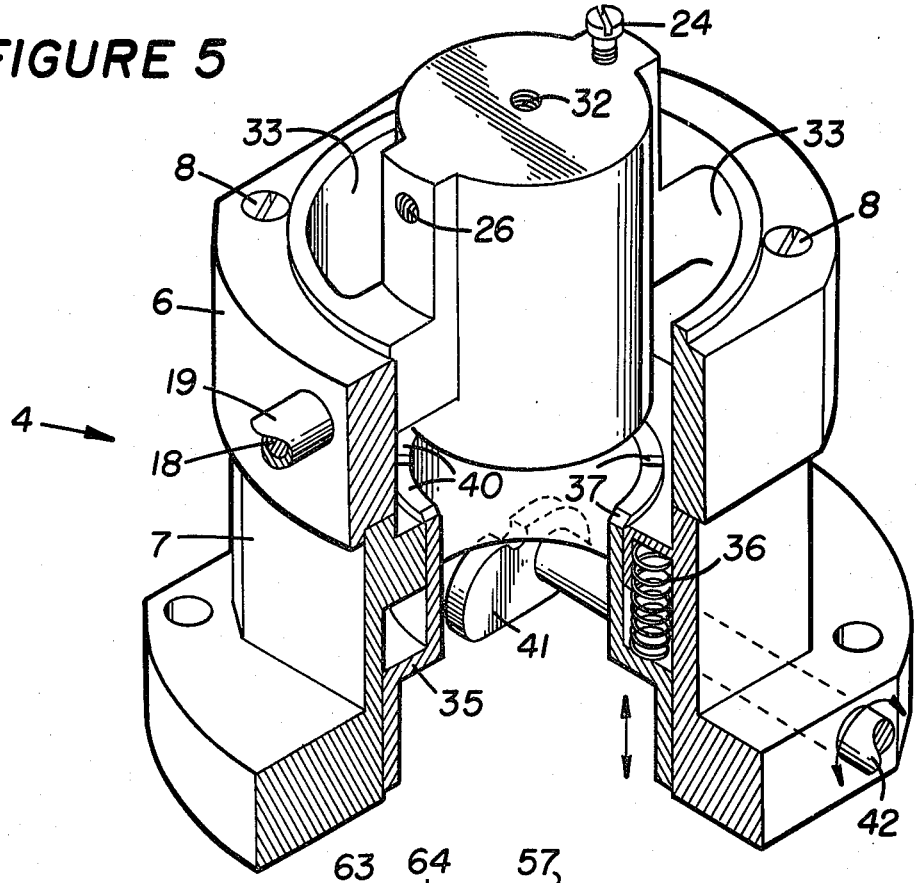
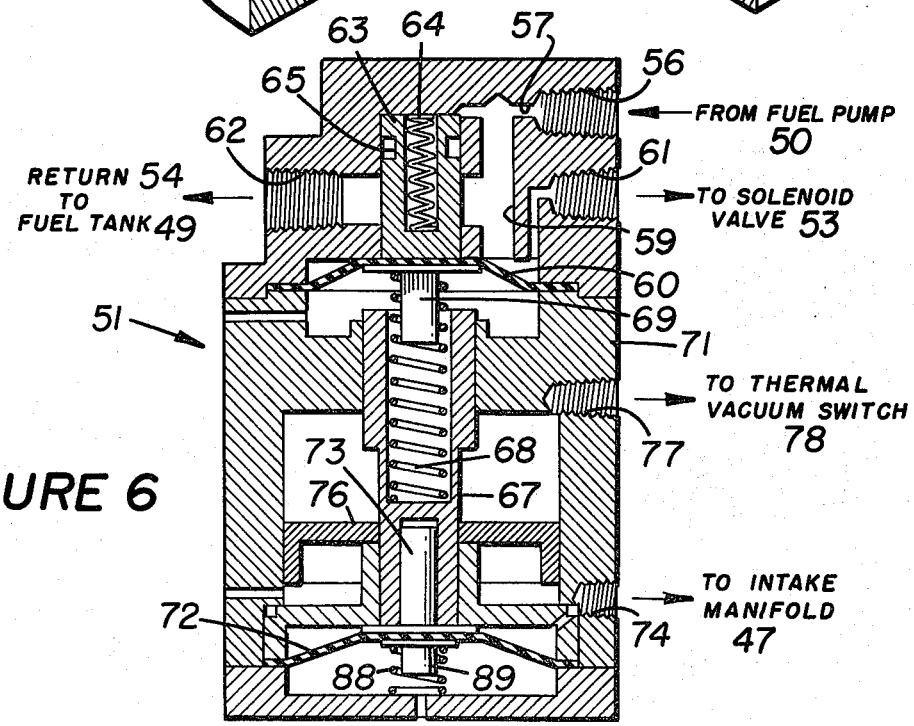
FIGURE 6

CARBURETOR, CONTROL APPARATUS AND METHOD FOR INTERNAL COMBUSTION ENGINES

1. Technical Field

This invention relates generally to fluid distribution apparatus having multiple valves and, more particularly, to carburetors and associated control apparatus for internal combustion engines.

2. Background Art

Carburetors perform three functions for internal combustion engines when delivering a gaseous mixture of fuel and air to the cylinders. The first function is to control the speed of the engine by controlling the absolute pressure in the intake manifold of the engine. The second function is to introduce and meter the fuel into the air stream going to the cylinders. The third function is to mix the fuel with the air so that a uniform mixture is produced.

One problem with conventional carburetors is that the fuel within the fuel reservoir or float bowl is subject to inertial and gravity forces. The inertial forces are generated by cornering, stopping, and accelerating. The gravity forces stem from hill climbing and from operating at different attitudes. Both sets of forces place operating limitations on engines because they vary the relationship of the fuel and float bowl with respect to the main jets.

A further problem with conventional carburetors is the emission of unburned hydrocarbons from the carburetor. When fuel enters the float bowl and drops in pressure to atmospheric pressure, a portion of the fuel is immediately vaporized and can be released unburned to the atmosphere. In addition, heat from an engine that is not in operation can boil the fuel remaining in the float bowl and likewise cause the emission of unburned hydrocarbons.

An additional problem with conventional carburetors is in providing a uniform mixture to the engine. One aspect of this problem stems from using a butterfly valve to control the pressure drop across the carburetor. At any angle less than wide open throttle, the butterfly valve deflects the flow through the carburetor. Also, when fuel impinges on the butterfly valve, the denser parts of the mixture tend to come off the lower side of the butterfly valve. Another aspect of the problem occurs at idle and low speeds when there is not sufficient air flow through the carburetor to operate the main venturi system. In this case fuel is introduced into the air stream in the carburetor via an idle port located below the butterfly valve and via a transfer slot located just above the idle port. The idle port and the transfer slot are located on just one side of the throat and hence cannot provide a uniform distribution of fuel across the throat of the carburetor.

A typical four barrel carburetor contains more than one hundred parts and is consequently complicated to manufacture and to assemble. These carburetors also require critical adjustments both during installation and at subsequent times. This complexity means that conventional carburetors are expensive and may be subject to frequent repair.

Recently there has been wide interest in converting carburetors over to alternative fuels such as ethanol and methanol. The stoichiometric air fuel ratio for these popular alcohol mixtures is much higher than for gasoline. In other words, as the percentage of alcohol is increased in the fuel, the engine tends to run leaner. In order to use a gasoline fuel containing more than ten percent (10%) alcohol, the fuel passages in a conventional carburetor must be substantially enlarged and the jets changed. Such a conversion almost mandates replacement of a conventionally constructed carburetor.

Work in this area of technology includes U.S. Pat. No. 4,137,284 entitled "Carburetor", issued Jan. 30, 1979 to Barbee, and U.S. Pat. No. 3,943,205 entitled "Internal Combustion Engine", issued Mar. 9, 1976 to Oliver.

The present invention is directed to overcoming one or more of the problems as set forth above.

DISCLOSURE OF THE INVENTION

In one aspect of the present invention a carburetor for an internal combustion engine is contemplated. This carburetor includes a carburetor head having a fuel inlet conduit and an air inlet conduit communicating with a fuel mixing chamber. The carburetor further includes metering means for controlling the amount of fuel and air entering the mixing chamber. The mixing chamber connects to an expansion chamber through a control orifice in the carburetor head. The carburetor also includes a carburetor housing having a throat that communicates with the expansion chamber and with an air delivery passage. Air entering the throat is metered with an air valve that is moved with respect to the air delivery passage in correspondence with the fuel metering means.

In the present invention the problem of inertial and gravitational forces acting on the fuel in the fuel bowl is overcome by eliminating the fuel bowl and all other fuel reservoirs in the carburetor. Fuel metering is no longer affected by inertia and the carburetor can be operated at any attitude without disturbing the process of fuel metering. Elimination of the fuel bowl also alleviates the problem of emitting unburned hydrocarbons. In the present invention vapor is not allowed to escape to the atmosphere.

The present invention provides a uniform fuel mixture to the engine by first premixing the fuel with air first in a mixing chamber, and secondly in a centrally located expansion chamber and then lowering the momentum of the mixture so that it can flow radially outward and mix with the primary air along a 360° circular front. This technique results in an extremely uniform mixture reaching the intake manifold of the engine.

One feature of the present invention is the precise fuel metering that can be obtained. A single fuel metering circuit is used to provide all of the fuel to the carburetor from idle through full throttle. No artificial enrichment devices are required, such as idle feed circuits, low speed circuits, and accelerator pumps. In addition, the transitions between such circuits are avoided.

A further feature of the present invention is its mechanical simplicity and use of few moving parts. The apparatus disclosed herein is less expensive to manufacture and to maintain than presently available carburetors. The use of only one fuel metering circuit also permits this carburetor to be easily controlled electronically and to be easily converted over to the use of alternative fuels.

The present invention is adapted to incorporate a solenoid operated fuel valve. Fuel flow to the carburetor is terminated either when the engine is decclerated or when the ignition key is turned off. This feature substantially reduces fuel consumption.

Other aspects, objects and advantages of this invention can be obtained from a study of the drawings, the disclosure, and the appended claims.

BRIEF DESCRIPTION OF THE DRAWINGS

FIG. 3 is a side elevational view in cross section taken along line III—III of FIG. 2.

FIG. 4 is a bottom plan view of the carburetor of FIG. 1.

FIG. 5 is a perspective view, partially cut away, of the carburetor of FIG. 1.

FIG. 6 is a side elevational view, in cross section, of a fuel pressure regulator according to one embodiment of the present invention.

BEST MODE FOR CARRYING OUT THE INVENTION

Figure 1:
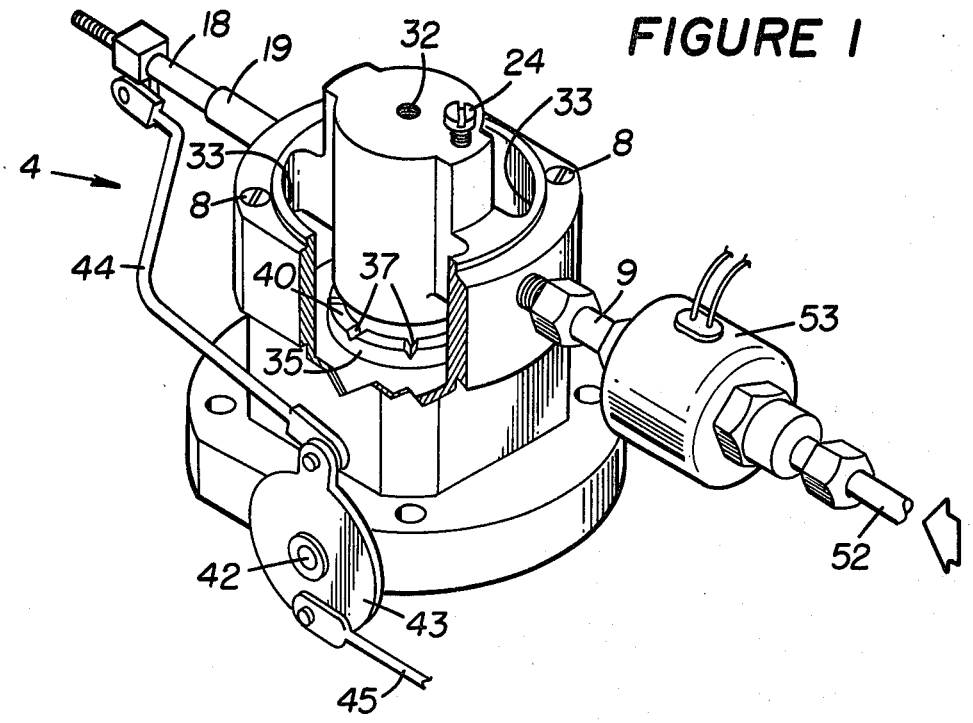
FIG. 1 is a perspective view, partially cut away, of a carburetor according to one embodiment of the present invention.

For the purpose of definition the term "high vacuum" means the condition wherein the absolute pressure in the intake manifold is sufficiently low such that the differential pressure between atmospheric pressure and the manifold pressure, as measured with a vacuum gage, is relatively high. High vacuum conditions occur during cruise and deacceleration phases of engine operation. "Low vacuum" is the condition wherein the absolute pressure in the intake manifold is close to atmospheric such that the differential pressure between atmospheric pressure and intake manifold pressure is low, as measured with a vacuum gage. Low vacuum conditions occur during acceleration, high engine speeds, and high engine loading. "Decreasing vacuum" is the condition occurring when the throttle is opened or the load on the engine increases. "Increasing vacuum" is the condition occurring when the throttle is closed or the load on the engine decreases.

Referring to the drawings, FIGS. 1-5 illustrate a carburetor 4 according to one embodiment of the present invention. The carburetor comprises an upper carburetor head 6 and a lower carburetor housing 7. The housing and head are rigidly bolted together with a plurality of bolts 8.

Fuel enters the carburetor 4 through a fuel line 9 which is attached to the carburetor head 6 by a conventional fitting 10. The fuel flows into a fuel inlet conduit 11 at a pressure of between 1-4 psi during normal operating conditions and up to 7 psi during cold start conditions, as described below. This fuel pressure has been empirically determined to provide the desired amount of enrichment under low manifold vacuum conditions and the proper amount of mixture leaning during high manifold vacuum conditions while still allowing the air bleed and the vacuum control orifice to be conveniently sized, as also described below.

Referring to FIG. 3, the fuel in the fuel inlet conduit 11 flows through a main metering jet 14 which is rigidly attached to the carburetor head 6 by a press-fit. The fuel thereafter flows into a mixing chamber 16 that is centrally located within the carburetor head 6. The flow of fuel through the main metering jet 14 is controlled by a main metering needle 18. The reduced portion of the main metering needle centered in the main metering jet is tapered and is moved in and out of the main metering jet to change the annular flow area therebetween. The motion of the main metering needle 18 is guided by a sleeve 19 which is also rigidly attached to the carburetor head 6 by a press-fit. The main metering needle is connected by linkage to an air valve and a throttle linkage, described below.

Referring to FIG. 3, an idle fuel enrichment passage 21 is in parallel with the main metering jet 14. This passage includes an orifice 23 having a fuel flow area that is varied by an idle mixture needle 24. The purpose of the idle fuel enrichment passage 23 and the enrichment needle 24 is to provide a fine adjustment to the carburetor for low speed operation. At high flow rates the idle fuel enrichment passage 21 does not make a significant contribution to the operation of the carburetor.

Referring to FIG. 3, the carburetor head 6 further includes an air inlet conduit 26 leading to the mixing chamber 16. The flow of air through the conduit 26 is controlled by an air flow restrictor 27. Further, in the bottom of the mixing chamber 16 is a vacuum control orifice 29. The control orifice communicates to a centrally located expansion chamber 30 located in the bottom of the carburetor head 6. The size of the air flow restrictor 27 in relation to the size of the mixing chamber vacuum control orifice 29 determines the absolute pressure within the mixing chamber as a function of manifold vacuum.

The diameter of the vacuum control orifice 29, FIG. 3, is made as small as possible while still permitting a sufficient amount of vaporized fuel to pass through the orifice for operation of the engine at high speed and under load.

The diameter of the air flow restrictor 27, FIG. 3, is sized with respect to the diameter of the vacuum control orifice 29 and the fuel pressure in the fuel inlet conduit 11 so that the carburetor automatically adjusts to changes in engine load. The diameter of the air flow restrictor is made sufficiently large so that substantial premixing of the fuel and air occurs in the mixing chamber 16. However, the diameter of the restrictor 27 is kept sufficiently small so that a vacuum is maintained in the mixing chamber. The flow of fuel into the mixing chamber is a function of the vacuum in the mixing chamber as well as the position of the metering needle 18 with respect to the jet 14 and the fuel pressure in the fuel inlet conduit 11.

If the throttle is opened to some position and held there, for example, a very low vacuum is initially generated in the intake manifold and the flow area through the jet is increased. The mixture thus formed in the mixing chamber 16 initially will be very rich. As the engine increases in speed, the manifold vacuum increases and the differential pressure across the main metering jet 14 also increases. However, the proportional increase in the differential pressure across the main metering jet 14 is not as great as the proportional increase in the differential pressure across the carburetor. This is because the differential pressure across the main metering jet 14 has two components; the fuel pressure supplied by the fuel pressure regulator 51 and the vacuum in the mixing chamber 16. Only the vacuum in the mixing chamber increases in relation to increases in manifold vacuum and, therefore, the total differential pressure across the main metering jet 14 increases at a lower rate than the rate of increase in manifold vacuum. This results in the mixture ratio becoming leaner as the manifold vacuum is increased.

The fuel and air pass through the vacuum control orifice 29 in a stream flowing along the center axis 31 of the carburetor. The stream expands into the expansion chamber 30 which forms a diffuser so that the velocity of the stream along the center axis 31 is decreased as much as possible. The ratio of the diameter of the control orifice 29 to the diameter and length of the expansion chamber 30 is designed so that by the time the mixture reaches the bottom 38 of the carburetor head 6 it can pass radially outward from the center axis 31 in a plane orthogonal to the axis as illustrated in FIG. 3. The outward tulip-like flow illustrated in FIG. 3 occurs because the pressure of the mixture in the expansion chamber 30 is greater than the pressure of the incoming air passing through the restriction at point 40 formed between the upper surface of the air valve 35 and the lower surface of the head 6.

Figure 7:
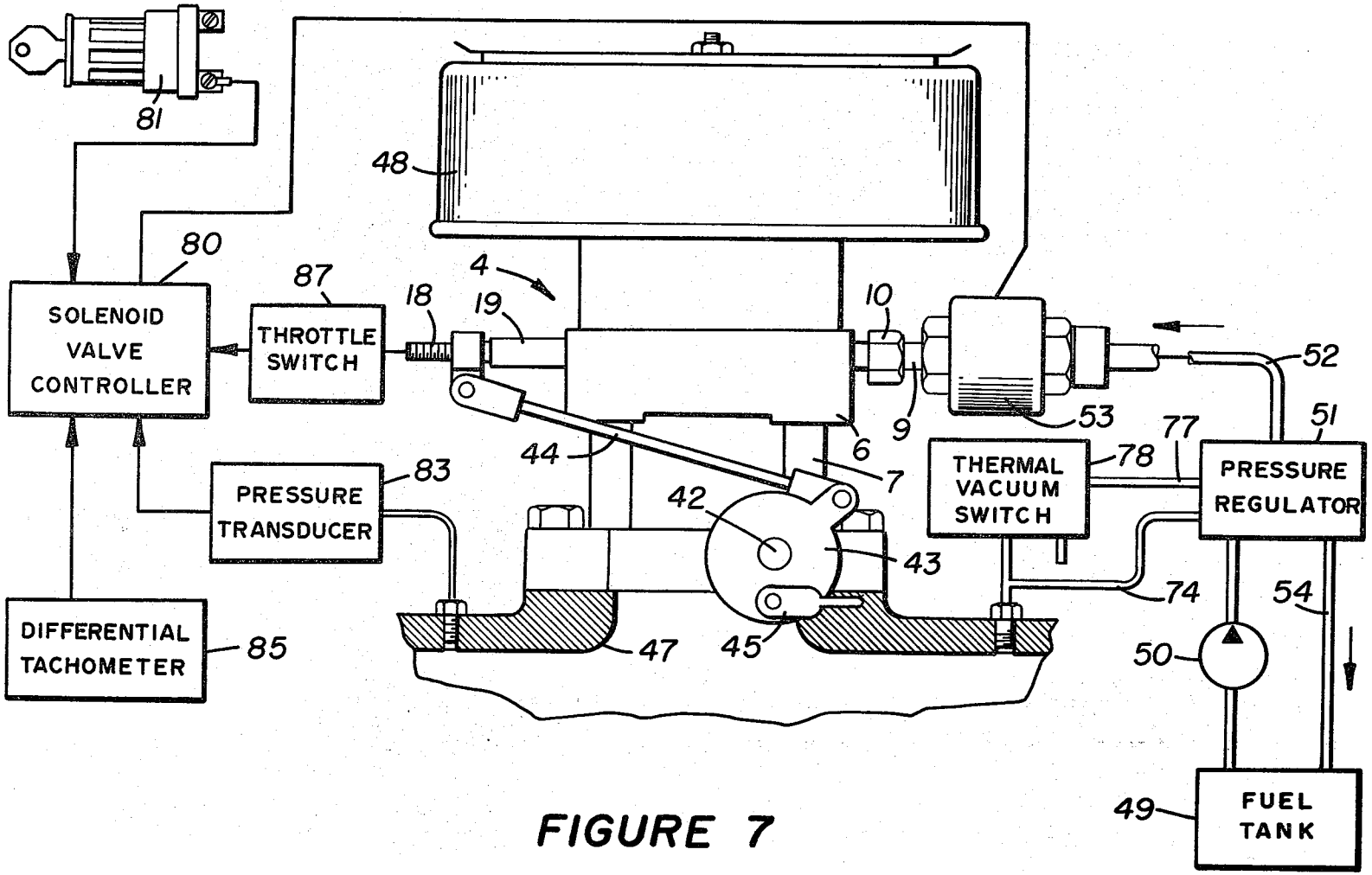
FIG. 7 is a schematic diagram of the carburetor of FIG. 1 and its associated control apparatus.

Referring to FIG. 1, the head 6 of the carburetor also includes a tapped hole 32 for receiving a bolt that attaches an air cleaner 48, FIG. 7, to the carburetor. Further, the head includes two large air intake ports 33. These ports direct atmospheric air (primary air) from the air cleaner into contact with the premixed fuel flowing radially outward along the bottom 38 of the carburetor head 6.

The carburetor head 6 is rigidly bolted to the carburetor housing 7 as described above. The carburetor housing 7 contains an air valve 35 having the shape of a right circular cylinder and an annular cross section. The air valve is stepped as illustrated in FIG. 3 for engagement by a cam 42 as described below. The central open portion of the air valve encloses the throat 39 of the carburetor. The throat 39 communicates directly to the intake manifold 47, FIG. 7, of the engine on which the carburetor is mounted. The air valve is urged in a downward direction as illustrated in FIG. 3 by a plurality of springs 36 which engage the housing 7. The air valve also includes a plurality of air valve channels 37 in the top annular margin of the air valve. These channels form high velocity flow paths for the incoming primary air when the air valve is near its seat on the bottom surface 38 of the carburetor head 6. These flow channels are provided to enhance mixing of the vapor at idle and at low speeds and have virtually no effect at high engine speeds where the air valve is open wide. The size and the location of the flow channels are empirically determined such that the air valve is not quite touching the bottom surface 38 of the carburetor head 6 when the air valve is in the closed (idle) position.

Figure 2:
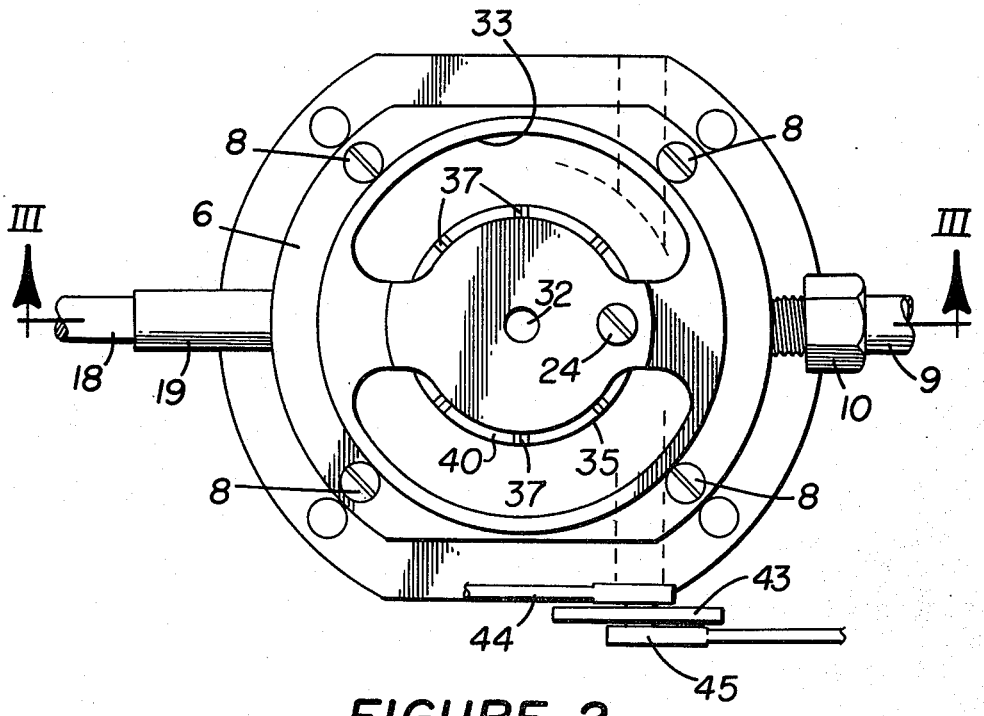
FIG. 2 is a top plan view of the carburetor of FIG. 1.

It should be appreciated from FIGS. 1-3 that the primary air encounters the fuel across the top of the air valve 35 along a 360° circular front at point 40 and then flows downward into the throat area 39 of the carburetor. The flows of fuel, air, and the mixture thereof are all symmetric and uniformly distributed about the center axis 31 of the carburetor.

Referring to FIGS. 1, 3, 4 and 5, the air valve 35 slides up and down within the carburetor housing 7 as controlled by a cam 41. The springs 36 urge the air valve against the cam. The cam is rotated by a cam shaft 42 which is mounted for rotation with respect to the carburetor housing 7. The cam shaft is rigidly connected to a link 43, FIG. 1, which is actuated by a throttle linkage 45 of conventional construction. The link also connects to a main metering needle linkage 44 that provides reciprocal motion to the main metering needle 18, FIG. 3. The cam 41 and the linkage 44 are arranged so that when the throttle linkage 45 is moved to produce a higher power level, the air valve 35 moves downward to increase the opening for primary air to enter the throat 39. Concurrently, the main metering needle 18 moves to the left as illustrated in FIG. 3 to enlarge the opening of the main metering jet 14. This increases the amount of fuel flowing into the mixing chamber 16.

The cam 41, FIG. 3, is designed to have an operating range of 80° which is compatible with a conventional carburetor's throttle linkage. Further, the profile of the cam is such that the relationship between the opening of the air valve and the movement of the throttle linkage is sinesoidal. The cam provides a much lower rate of air valve opening at lower power levels. This profile is chosen empirically to give the operator of the engine roughly the same throttle characteristics as a conventional carburetor.

FIG. 7 illustrates the carburetor 4 installed on an intake manifold 47 with an air cleaner 48. The air cleaner is of conventional construction. Fuel for the carburetor is stored in a fuel tank 49 and is pumped therefrom by either a mechanical or an electric fuel pump 50. The fuel pump discharges into a fuel pressure regulator 51 described in detail below and illustrated further in FIG. 6. The pressure regulator in turn discharges into a line 52 which is connected to an electrically actuated solenoid valve 53 that is connected to the fuel line 9 leading to the carburetor as described above. The solenoid valve is a two position binary valve that controls whether or not the flow takes place between the fuel pressure regulator 51 and the carburetor 4.

The pressure regulator 51 is illustrated in detail in FIG. 6. The pressure regulator is a return type regulator that returns any vapor in the fuel and any over pressure to the tank 49 via a return line 54. The pressure regulator controls the fuel pressure delivered to the carburetor 4 and hence affects its metering. In addition, the pressure regulator provides a means to enrich the mixture during periods of cold operation. The regulator is connected to the fuel pump 50 so that fuel therefrom enters a fuel inlet 56. The fuel inlet connects to a constricted passage 57 which discharges into a vapor separating chamber 59. The purpose of the constricted passage is to accelerate the fuel and to cause any vapor in the fuel to flash in to vapor in the separating chamber 59. The separating chamber is vertically elongate and has upper, medial, and lower sections. The bottom of the chamber is formed by a main diaphragm 60 fabricated from a deformable material. The under side of the diaphragm is vented to the atmosphere. The liquid fuel in the separating chamber 59 passes out of the chamber through a fuel outlet passage 61 which connects to conduit 51, FIG. 7, and the solenoid valve 53. The fuel outlet passage 61 has an opening in the bottom section of the chamber near the diaphragm 60 so that only fuel in liquid form is taken into the outlet 61.

Vapor in the pressure regulator 51, FIG. 6, collects in the upper and medial sections of the vapor separating chamber 59. The vapor is vented back to the fuel tank 49 through a return passage 62 that is controlled by a spool valve 63. The spool valve bears against the main diaphragm 60 and is lightly urged downward by a positioning spring 64. The spool valve contains a relieved portion 65 which, when in register with the return passage 62, permits the vapor in the separating chamber 59 to return to the fuel tank 49.

Referring to FIG. 6, the position of the spool valve 63 is controlled by a loading piston 67 that slides up and down with respect to the pressure regulator housing 71 and a stationary spacer 70. Within the loading piston is a main spring 68 which engages a guide 69. The spring urges the guide upward against the bottom side of the main diaphragm 60 and urges the loading piston 67 downward. Below the stationary spacer 70 is a second guide 73 that engages a second diaphragm 72 fabricated from a deformable material. The lower side of the second diaphragm 72 is vented to the atmosphere and the upper side of the diaphragm is connected by a passage 74 to the intake manifold 47, FIG. 7. During operation of the engine the vacuum in the manifold is communicated to the top of the secondary diaphragm 72. This vacuum causes the guide 73 to become elevated to the position shown in FIG. 6 against the bottom of the spacer 70. The purpose of the second diaphragm 72 is to modulate the fuel pressure from the regulator in relation to engine vacuum. When the vacuum is low, the pressure regulator reduces the output fuel pressure to the carburetor 4. A compression coil spring 88 and guide 89 therefore may be disposed below the second diaphragm 72 to augment the upward force imposed on the diaphragm to thereby modify the fuel pressure response to manifold vacuum. In the present invention vacuum conditions low enough to cause guide 73 to move away from spacer 70 occur only when the vehicle is traveling at slow speeds and then is suddenly accelerated.

The fuel pressure regulator 51, FIG. 6, also includes a cold start piston 76 which engages a stepped area on the loading piston 67. The under side of the cold start piston 76 is vented to the atmosphere and the upper side of the piston is connected by a passage/conduit 77 to a thermal vacuum switch 78 of conventional construction. The thermal vacuum switch senses the cooling water temperature of the engine. For operation below 90° F. conduit 77 is connected to the vacuum in the intake manifold 47, FIG. 7 and the cold start piston 76 is drawn to the top of the chamber, thereby elevating the loading piston 67. For operation above 90° F. the thermal vacuum switch 78 vents conduit 77 to the atmosphere. Since the under side of the cold start piston 76 is also vented to the atmosphere, the cold start piston descends, comes to rest on the spacer 70, and does not engage the loading piston 67.

During normal operation above 90° F., which is illustrated in FIG. 6, the loading piston 67 is down and in contact with the guide 73 which is forced upward against the bottom of the spacer 70 by the vacuum in the top of the second diaphragm 73. The cold start piston 76 is likewise down and in contact with the spacer 70 because conduit 77 is vented to the atmosphere by the thermal vacuum switch. In this configuration the main spring 68 regulates the output pressure of the fuel.

For operating conditions when the engine has a coolant temperature below 90° F., the cold start piston 76 is drawn up against the loading piston 67 which is likewise forced upward. This moves the spool valve 63 to the top of the vapor separating chamber 59 and causes the output fuel pressure in the passage 61 to increase and thereby enrich the mixture produced by the carburetor.

Referring to FIG. 7, the solenoid valve 53 is an electrically controlled binary valve that is opened and shut by a solenoid valve controller 80. The solenoid valve controls the flow of fuel to the carburetor 4 from the pressure regulator 51 in a binary mode. The solenoid valve controller 80 is connected to the ignition switch 81 of the engine. Inter alia, the ignition circuit of the engine must be energized in order to open the solenoid valve 53 and start the engine. In addition, when the ignition switch is turned off, the solenoid valve 53 is immediately shut so that the flow of fuel to the carburetor is immediately stopped. This prevents the engine from running with the ignition off. Further, by immediately shutting the solenoid valve 53 when the ignition is de-energized, the flow of fuel is cut off while the engine is still rotating and the emission of hydrocarbons is substantially reduced.

The solenoid valve controller 80, FIG. 7 also receives signals from a conventional pressure transducer 83 connected to the intake manifold 47 of the engine. The pressure transducer senses the vacuum in the manifold and causes the solenoid valve to open and close at various times during start-up and during operation. In particular, during start-up the pressure transducer signals the solenoid valve controller 80 when there is a slight vacuum in the manifold 47 indicating that the engine is turning over. The solenoid valve controller does not open the solenoid valve 53 during start up unless the ignition switch 81 is energized and there is a slight vacuum in the manifold 47. This is done to ensure that fuel is supplied to the engine only when it is turning-over. In addition, should the engine ever become flooded, depressing the throttle such that the vacuum in the manifold is not great enough to energize the solenoid, will stop the flow of fuel and the flooded condition can be easily cleared.

Typically, a set point on the order of one-half to one inch of mercury is used. During operation of the engine the pressure transducer 83 signals the solenoid valve controller 80 to shut the solenoid valve 53 when the engine is being decelerated. This condition occurs when the vacuum in the intake manifold as sensed by the transducer 83 exceeds a predetermined value. By shutting the solenoid valve 53 during periods of deceleration, substantial fuel savings are achieved and emissions are reduced. The pressure transducer 83 also subsequently signals the solenoid valve controller 80 to reopen the solenoid valve 53 so that the engine does not die. This condition occurs when the solenoid valve is shut due to high vacuum and then the vacuum in the manifold as sensed by the transducer 83 decreases to a predetermined value. In a typical installation the solenoid valve is shut when the vacuum in the manifold exceeds 20 inches of mercury and the solenoid valve is reopened when the manifold vacuum decreases to 10 inches of mercury.

The solenoid valve controller 80, FIG. 7, also receives signals from a differential tachometer 85 that measures the rate of change of engine speed. During periods of very rapid engine deceleration a signal from the differential tachometer adds a bias to the signal from the pressure transducer 83 so that the solenoid valve 53 is opened sooner and prevents the engine from dying. Such a rapid change in engine speed occurs when the brakes on the vehicle are applied hard. In a typical installation the set point at which the solenoid valve 53 is reopened is raised to approximately fifteen inches of mercury. During periods of rapid engine acceleration, the differential tachometer 85 also raises the set point at which the solenoid valve 53 is shut. This is done to prevent the solenoid valve from cycling open and shut when the engine is being rapidly accelerated and decelerated and is not under load. Typically, the set point at which the solenoid valve is shut is raised to twenty-five inches of mercury.

The solenoid valve controller 80, FIG. 7 also receives a signal from a mechanical throttle switch 87 attached to the throttle linkage 44, 18 of the carburetor 4. The throttle switch produces an overriding signal that causes the solenoid valve controller 80 to reopen the solenoid valve 53 if the throttle linkage is actuated to open the throttle when the engine is decelerating and the pressure transducer has previously caused the controller 80 to shut the solenoid valve 53. This situation occurs when the engine is decelerating and the operator of the engine moves the throttle linkage 45 to stop the deceleration and to bring the engine back up to speed. Movement of the linkage causes the controller 80 to open the solenoid valve 53 without having to wait until the vacuum in the intake manifold 47 decreases to below ten inches of mercury in the manner described above.

OPERATION

The carburetor 4 and its associated control apparatus, FIG. 7, have two starting modes. There is a normal starting mode when the engine is warm and a cold starting mode when the coolant temperature of the engine is below 90° F., as sensed by the thermal vacuum switch 78. Below 90° F. the thermal vacuum switch connects conduit 77 to the vacuum in the manifold 47. Above 90° F. the thermal vacuum switch vents conduit 77 to the atmosphere.

More particularly, in the normal starting mode the ignition switch 81 is first turned to the on position and the solenoid valve controller 80 is thereby energized. The solenoid valve 53 remains shut and, if the fuel pump 50 is electrically driven, the fuel pump begins to run. Once the fuel line 52, FIG. 7 is pressurized, fuel is recycled back to the tank 49 through the return line 54. When the starter (not shown) is actuated and the engine begins to rotate, a vacuum is created in the intake manifold 47. This vacuum causes the pressure transducer 83 to signal the solenoid valve controller 80 to open the solenoid valve 53. At this point if the fuel pump 50 is mechanically driven, fuel is delivered to the pressure regulator 51 and to the discharge conduit 52. The position of the throttle linkage 45, it is believed, is not critical during starting. The position of the air valve 35, FIG. 3 merely determines the speed at which the engine runs once the engine is started.

Referring to FIG. 6, before any vacuum is developed in the intake manifold 47, FIG. 7, the secondary diaphragm 72 and the loading piston 67 are both in their most downward position in the pressure regulator 51. Since the engine is warm, the thermal vacuum switch 78, FIG. 7 vents conduit 77 to the atmosphere and the cold start piston 76 is likewise at its lowermost position. The spool valve 63 is thus subjected to only the compression force of the main spring 68, the positioning spring 64, spring 88, and the fluid pressure on the main diaphragm 60. The spool valve tends to be in its lowermost range of motion with the relieved portion 65 of the valve nearer the return passage 62.

When the engine starts and a vacuum is developed in the intake manifold 47, this vacuum is communicated to the upper side of the secondary diaphragm 72, FIG. 6, of the pressure regulator 51. This vacuum causes the guide 73 to elevate the loading piston 67 and thereby elevate the spool valve 63. This motion of the spool valve tends to shut the return line 54 to the fuel tank and to cause the pressure developed by the fuel pump 50 to be communicated to the solenoid valve 53. The cold start piston 76 remains in its bottommost position because the thermal vacuum switch 78 vents conduit 77 to the atmosphere. Thus, at normal operating temperatures the regulated fuel pressure produced by the pressure regulator is determined by the loading of the main spring 68 and the positioning spring 64.

Referring to FIG. 7, during the cold start mode of engine start-up, the thermal vacuum switch senses that the temperature of the engine coolant is below 90° F. and connects conduit 77, FIG. 7, to the intake manifold 47 so that the vacuum developed in the manifold is communicated to the top of the cold start piston 76. When the engine starts, the vacuum moves the cold start piston 76, FIG. 6, upward to engage the loading piston 67 and to move it upward. The net effect is that the spool valve 63 is biased upward and the fuel pressure supplied to the carburetor is increased. The remaining control apparatus and the carburetor operate in the manner described above.

After the engine is running, fuel is pumped from the fuel tank 49 by the fuel pump 50 to the pressure regulator 51. The pressure regulator removes any vapor from the fuel and regulates the pressure of the fuel supplied to the solenoid valve 53 depending on whether the temperature of the engine coolant is above or below 90° F. If the engine is not being rapidly accelerated or decelerated, the solenoid valve 53 is open and fuel enters the carburetor 4 through the fuel line 9, FIG. 3. A portion of the fuel passes through the idle fuel enrichment passage 21 as well as through the main metering jet 14. Both of these fuel passages deliver fuel to the mixing chamber 16 where the fuel is premixed with air entering through the air inlet conduit 26. The mixture of air and fuel thus formed passes out the bottom of the mixing chamber through the vacuum control orifice 29. Once through this orifice, the mixture of fuel and air enters the expansion chamber 30 where the velocity of the flow and the momentum of the mixture is substantially reduced. Premixing continues in the expansion chamber. The premixed fuel then passes downward out of the bottom of the expansion chamber 30, turns ninety degrees, and flows radially outward along the bottom surface 38 of the carburetor head 6. This flow occurs because the pressure of the fuel in the expansion chamber 30 is higher than the pressure of the primary air entering the carburetor through the restriction at point 40. This flow also occurs because the velocity and momentum of the premixture exiting from the expansion chamber has been so reduced that the inertia of the flow does not drag it down into the throat 39 of the carburetor housing 7.

Primary air enters the carburetor 4 through the two air intake ports 33. This air mixes with the premixed fuel around the upper periphery 40 of the air valve 35 as illustrated in FIG. 3. It should be noted that air is introduced and mixing occurs across a 360° circular front. The air and the fuel mix together and thereafter flow downward into the throat 39 of the carburetor and into the intake manifold 47, FIG. 7, of the engine.

The output of the carburetor 4, FIG. 7, and the power developed by the engine is controlled by the throttle linkage 45. When the engine is accelerated, the throttle shaft 42, FIGS. 7, 3, is rotated so that the cam 41 lowers the air valve 35, thereby permitting more air to be introduced into the carburetor through the air intake ports 33. In addition, motion of the cam shaft 42, FIG. 3, actuates the linkage 44, FIG. 7, so that the main metering needle 18 moves to the left as illustrated in FIG. 3 and provides a larger opening for fuel flow through the main metering jet 14.

The carburetor automatically adjusts to changes in engine load. The flow of fuel into the mixing chamber is a function of the vacuum in the mixing chamber as well as the position of the metering needle 18 with respect to the jet 14 and the fuel pressure in the fuel inlet conduit 11. When the throttle linkage is moved to some position to accelerate the engine and held there, the metering needle 18 moves so that the flow area through the jet is increased. In addition, the vacuum in the intake manifold 47 and in the throat 39 is reduced. This low manifold vacuum consequently decreases the pressure drop across the main metering orifice 14. At this time, the flow of fuel into the carburetor is largely due to the fuel pressure supplied by the pressure regulator 51 as the vacuum in the mixing chamber 16 is relatively low. As the engine speed increases, the manifold vacuum as well as the vacuum in the mixing chamber 16 increase. The flow of fuel into the carburetor also increases due to the increase in the vacuum applied to the main metering jet 14. However, the proportional increase in fuel flow is not as great as the proportional increase in air flow through the carburetor as the increased vacuum in the mixing chamber 16 only increases one component of the total pressure differential across the main metering jet 14.

The other component, the fuel pressure supplied by the fuel pressure regulator 51, does not normally increase in response to increases in engine vacuum. Therefore, the proportional increase in fuel flow in relation to increasing manifold vacuum is smaller than the proportional increase in air flow through the carburetor for any given air valve 35 position. The carburetor thereby provides a lean mixture at high vacuum (low engine load) and a rich mixture at low vacuum (high engine load).

During periods of very rapid acceleration at low engine speeds, the fuel pressure delivered by the pressure regulator 51, FIG. 6, is reduced due to the reduction in manifold vacuum acting on the secondary diaphragm 72 of the pressure regulator. Further, a rapid increase in engine speed causes the differential tachometer 85, FIG. 7 to signal the solenoid valve controller 80 to raise the set point at which the solenoid valve 53 is shut.

Deceleration is the reverse of the above described sequence. However, if during deceleration the vacuum in the manifold 47 exceeds a threshhold value (approximately twenty inches of mercury), the pressure transducer 83, FIG. 7 signals the solenoid valve controller 80 to shut the solenoid valve 53. This interrupts the flow of fuel to the carburetor and to the engine and thereby reduces fuel consumption and emissions. As the engine loses speed, the vacuum in the manifold 47 decreases and at a predetermined value (approximately ten inches of mercury for vehicles with automatic transmissions, and higher for vehicles with manual transmissions), the pressure transducer 83 signals the solenoid valve controller 80 to reopen the solenoid valve 53. The flow of fuel to the carburetor 4 is thereby re-established and the engine is prevented from dying.

If the deceleration is very rapid, the differential tachometer 85, FIG. 7, raises the set point (approximately fifteen inches of mercury) at which the solenoid valve 53 is reopened. This further prevents the engine from dying by having the flow of fuel re-established earlier.

If the throttle linkage 45 is actuated during deceleration when the solenoid valve 53 is shut, the throttle switch 87, FIG. 7, will override the pressure transducer 83 and will signal the solenoid valve controller 80 to reopen the solenoid valve 53. This allows the operator of the engine at all times to be able to accelerate the engine.

To stop the engine, the ignition switch 81, FIG. 7, is turned to the off position and electrical power to the solenoid valve controller 80 is interrupted. This causes the solenoid valve 53 to close and the flow of fuel to the engine to be immediately stopped. In addition, the ignition circuit (not shown) is de-energized. When the throttle linkage 45 is released, a spring (not shown) causes the cam 41 to rotate and to raise the air valve 35 to its most upward position. In addition, the main metering linkage 44 causes the main metering needle 18, FIG. 3, to move to its most rightward position with respect to the main metering jet 14 as illustrated in FIG. 3.

The following table is a listing of the technical specifications of one embodiment of the present invention that was constructed and operated. The test vehicle was a 1970 Ford Maverick equipped with a 200 cu. in. 6 cylinder engine and a three-speed automatic transmission:

TABLE 1

| | |
|---|---|
| Bore through air valve | 1¼" |
| Maximum air valve opening | .350" |
| Vacuum control orifice thickness | ⅛" |
| Vacuum control orifice hole dia. | ⅛" |
| Air flow restrictor hole dia. | ⅛" |
| Expansion chamber dia. | 11/32" |
| Air valve channels, quantity-8 | 45° (angle between bisector or axis 31 and surface of channel 37 in FIG. 3) .050" (depth of channel 37) |
| Main metering jet dia. | .0894 |
| Main metering needle travel | 1⅜" |
| Main metering needle dia. at large end | .089 |
| Main metering needle dia. at small end | .063 |
| Fuel pressure, hot | 2½ psi |
| Fuel pressure, cold | 4 psi |

Although the preferred embodiment described above incorporates a main metering needle 18 in the shape of a tapered shaft having a circular cross section, other devices may be used to implement fuel metering. The purpose of the main metering needle is only to precisely regulate the amount of fuel delivered to the mixing chamber in relation to the air valve opening. For example, a rotary valve could be used. Further, a needle with a flat sidewall or a groove of varying depth could be used.

In addition, the linkage 44, FIG. 7, between the main metering needle 18 and the link 43 can be eliminated in favor of an electronically controlled positioning unit. Such a unit can independently position the main metering needle and the air valve in nonlinear modes to suit varying operating conditions.

Although the embodiment described above incorporates an air valve 35, FIG. 3, which has a step in its diameter in order to provide a wall for the cam 41 to engage, an air valve having a uniform cross section without a step in its diameter could be used. In that case the air valve would be positioned by a direct mechanical linkage, such as a rack and pinion or a pin and fork arrangement.

In the fuel inlet conduit 9, FIG. 3, between the solenoid valve 53, FIG. 7, and the main metering jet 14, there is a small cavity which is not sealed. During deceleration the solenoid valve 53 shuts, but this small cavity is exposed to a high vacuum and some of the fuel therein evaporates. When the solenoid valve 53 later reopens, this cavity must be filled and the evaporated fuel must be replaced before the carburetor functions normally. This small volume can be sealed by an o-ring seal placed on the main metering needle 18. A similar arrangement can be used to close-off the idle fuel enrichment passage 21, FIG. 3.

In view of the foregoing it can be understood how the above-described carburetor and its associated control apparatus is able to mix fuel and air together into a homogeneous mixture that is uniformly distributed across the throat of the carburetor. This feature is obtained by the arrangement of the vacuum control orifice being centrally located in the carburetor and the expansion chamber being located below this orifice so that the flow of fuel can be reduced in velocity and then directed radially outward across the bottom of the carburetor head. Further, the fuel leaving the expansion chamber is brought into contact with the primary air around the periphery of the top of the air valve along a 360° circular front. At every point the flow of air, fuel, and mixture through the carburetor is concentric, uniform, and evenly distributed.

Further, it can be seen from the foregoing that the carburetor described above is able to precisely meter fuel over all operating ranges of the engine with only one fuel circuit. This permits very precise metering and allows a mechanical simplicity to carburetors that has heretofore been unobtainable.

Other aspects, objects and advantages of this invention can be obtained from a study of the drawings, the disclosure and the appended claims.

I claim:

1. A carburetor for an internal combustion engine, comprising:

(a) a carburetor head having a fuel mixing chamber;
(b) a fuel inlet conduit in the head for communicating fuel to the fuel mixing chamber;
(c) means, in the fuel inlet conduit, for metering the fuel entering the fuel mixing chamber;
(d) an air inlet conduit in the head for communicating air to the fuel mixing chamber;
(e) means, in the air inlet conduit, for metering the air entering the fuel mixing chamber;
(f) an expansion chamber in the carburetor head communicating with the mixing chamber in series through a control orifice;
(g) a carburetor housing attached to the carburetor head and having a throat communicating directly with the expansion chamber, said housing being mountable on an internal combustion engine with the throat in communication with an intake passage thereof;
(h) an air delivery passage in the carburetor for communicating air to the throat at a location adjacent to an outlet of said expansion chamber;
(i) an air valve in the carburetor head for metering the air entering the throat from the air delivery passage; and
(j) means, connected to the carburetor, for moving the air valve with respect to the air delivery passage in correspondence with the fuel metering means.

2. A carburetor as in claim 1 wherein the fuel and air from the mixing chamber flow through the control orifice and into the expansion chamber in a stream, said expansion chamber pre-mixes the fuel and air in the stream together and reduces the velocity thereof before said fuel and air enter the throat.

3. A carburetor as in claim 1 wherein said carburetor has a central axis of symmetry and said expansion chamber is an elongate passage in the carburetor head coincident with said central axis and said control orifice is received in the passage proximate to the mixing chamber and coincident with the central axis.

4. A carburetor as in claim 1 wherein said air valve has the shape generally of a right circular cylinder with an annular cross section and with an annular top margin and wherein said expansion chamber has a length and width sufficiently large that the fuel passing therethrough is so reduced in velocity that when the fuel flows out of the expansion chamber the fuel flows radially outward and mixes with air from the air delivery passage proximate to the top margin of the air valve.

5. A carburetor as in claim 1 wherein the air valve has the shape of a right circular cylinder with an annular top margin and wherein the carburetor head has a stationary annular seat that is engaged by said margin of the air valve.

6. A carburetor as in claim 1 including an idle fuel enrichment conduit for fuel in the head communicating with the fuel mixing chamber in parallel with the fuel inlet conduit.

7. A carburetor as in claim 1 wherein said air valve moving means includes a cam with a profile such that the air valve and the fuel metering means move together in a sinesoidal relationship.

8. A carburetor as in claim 1 wherein said air metering means includes a flow restrictor that maintains a vacuum in the mixing chamber for the fuel metering means.

9. Apparatus for an internal combustion engine for regulating the pressure of fuel from the output of a fuel pump, comprising:

(a) an elongate, upright housing;
(b) a vertically elongate chamber within the housing having bottom, medial, and upper sections;
(c) a fuel input conduit connectable to the output of a fuel pump and communicating with the upper section of the chamber, said conduit having a restriction therein which accelerates the fuel and causes any vapor in the fuel to form in the upper and medial sections of the chamber;
(d) a fuel output conduit communicating with the lower section of the chamber so that liquid fuel is passed therethrough;
(e) a return conduit for vapor and fuel communicating with the medial section of the chamber;
(f) a spool valve centrally received in the housing and vertically movable with respect thereto, said valve controlling the flow of fuel and vapor from the chamber into the return conduit; and
(g) a spring loaded diaphragm actuating said spool valve and sensitive to the pressure of fuel in the chamber such that when the pressure of fuel exceeds a predetermined value, said fuel and vapor are directed into the return conduit by the spool valve, thereby regulating the pressure of fuel in the fuel output conduit.

10. An apparatus as in claim 9 further including a piston that biases the diaphragm on command to increase the pressure of the fuel in the fuel output conduit.

11. An apparatus as in claim 9 further including a second diaphragm sensitive to vacuum from an exterior source and operatively connected to the spring loaded diaphragm such that when the vacuum from the exterior source decreases, the spring loaded diaphragm is biased to reduce the pressure of fuel in the fuel output conduit.

12. Carburetion apparatus for an internal combustion engine, comprising:

(a) a carburetor having therein a fuel mixing chamber, fuel and air inlet conduits communicating with the fuel mixing chamber, means for metering the fuel and air entering the fuel mixing chamber, an expansion chamber communicating with the mixing chamber through a controlled orifice, a throat communicating with the expansion chamber and with the internal combustion engine, an air delivery passage communicating with the throat, an air valve for metering air entering the throat from the air delivery passage, and means for moving the air valve with respect to the air delivery passage in correspondence with the fuel metering means;

(b) a fuel pressure regulator connected to the fuel inlet conduit of the carburetor and having therein a vertically elongate chamber having bottom, medial and upper sections, a fuel input conduit connectable to the output of a fuel pump and communicating with the upper section of the chamber, said conduit having a restriction therein which accelerates said fuel and causes any vapor in the fuel to form in the upper and medial sections of the chamber, a return conduit communicating with the medial section of the chamber, a spool valve centrally received in the regulator and vertically movable with respect thereto for controlling the flow of fuel and vapor from the chamber to the return conduit, a spring loaded diaphragm actuating said spool valve and sensitive to the pressure of fuel in the chamber such that when the pressure exceeds a predetermined value, said fuel and vapor are directed into the return conduit by the spool valve, and a vacuum controlled piston that biases the diaphragm to increase the pressure of fuel in the fuel output conduit;

(c) a source of vacuum;

(d) means, connectable to an internal combustion engine, for sensing the operating temperature thereof; and (e) means, connected to the temperature sensing means and to the fuel pressure regulator, for actuating said vacuum controlled piston and biasing the diaphragm to increase the pressure of fuel in the fuel output conduit of the fuel pressure regulator when the operating temperature of the internal combustion engine is less than a predetermined value.

13. Carburetion apparatus for an internal combustion engine, comprising:

(a) a carburetor having therein a fuel mixing chamber, fuel and air inlet conduits communicating with the fuel mixing chamber, means for metering the fuel and air entering the fuel mixing chamber, an expansion chamber communicating with the mixing chamber through a controlled orifice, a throat communicating with the expansion chamber and with the internal combustion engine, an air delivery passage communicating with the throat, an air valve for metering air entering the throat from the air delivery passage, and means for moving the air valve with respect to the air delivery passage in correspondence with the fuel metering means;

(b) an electrically actuated valve in the fuel inlet conduit to the carburetor for interrupting and restoring a flow of fuel thereto;

(c) valve control means, connected to said valve, for electrically actuating said valve; and (d) an ignition switch means for said internal combustion engine having an on position and an off position and connected to the valve control means, said ignition switch means causing said valve control means to interrupt said flow of fuel to the carburetor through said valve when the ignition switch means is in the off position, and said valve control means causing said valve to interrupt said flow of fuel to said carburetor when the ignition switch means is in its on position and the engine is not running.

14. Carburetion apparatus for an internal combustion engine having an intake manifold, comprising:

(a) a carburetor having therein a fuel mixing chamber, fuel and air inlet conduits communicating with the fuel mixing chamber, means for metering the fuel and air entering the fuel mixing chamber, an expansion chamber communicating with the mixing chamber through a controlled orifice, a throat communicating with the expansion chamber and with the internal combustion engine, an air delivery passage communicating with the throat, an air valve for meteing air entering the throat from the air delivery passage, and means for moving the air valve with respect to the air delivery passage in correspondence with the fuel metering means;

(b) an electrically actuated valve in the fuel inlet conduit to the carburetor for interrupting and restoring a flow of fuel thereto;

(c) valve control means, connected to said valve, for electrically actuating said valve;

(d) means, connected to the intake manifold of an internal combustion engine and the valve control means, for sensing the vacuum in the intake manifold and for actuating the valve control means to interrupt the flow of fuel to the carburetor when the vacuum in the intake manifold exceeds a first predetermined value and including means for actuating the valve control means to restore a flow of fuel to the carburetor after first being interrupted and after the vacuum diminishes below a second predetermined value; and (e) means, connected to the valve control means, for sensing the rate of change of the speed of the internal combustion engine and for varying the first predetermined value if the rate of change exceeds a third predetermined value.

15. An apparatus as in claim 14 including means, connected to the valve control means, for sensing the gate of change of the speed of the internal combustion engine and for varying the second predetermined value if the rate of change exceeds a fourth predetermined value.

16. An apparatus as in claim 14 including a throttle linkage connected to the carburetor and means, connected to the throttle linkage, for overriding said fuel interrupting means when said throttle linkage is actuated.

17. Method for providing a mixture of fuel and air to an internal combustion engine, comprising the steps of:

(a) metering fuel and air into a mixing chamber of a carburetor;

(b) maintaining a vacuum in said mixing chamber by passing said fuel and air through a control orifice in a stream flowing along a first axis;

(c) expanding said stream in an expansion chamber and thereby substantially decreasing the velocity of the stream along said axis;

(d) thereafter further expanding and directing said stream radially outward from said axis in a plane orthogonal to said axis;

(e) thereafter introducing primary air into the stream and thereby mixing said fuel and air together in a mixture; and (f) thereafter directing said fuel and air mixture back into a stream flowing along said first axis into an internal combustion engine.

18. A method as in claim 17 wherein the step of introducing primary air into the stream includes introducing said air into the fuel along a 360° circular front lying in said orthogonal plane.

19. A method as in claim 17 including the steps of:

(a) metering the primary air introduced into the stream and;

(b) sinesoidally coordinating the primary air metering with the fuel metering.

20. A method as in claim 17 including the steps of:

(a) regulating the pressure of the fuel prior to fuel metering and;

(b) removing any vapor in the fuel prior to fuel metering.

21. A method as in claim 17 including the steps of:

(a) providing fuel to the carburetor at a first predetermined pressure when the internal combustion engine operates at normal temperature and;

(b) providing fuel to the carburetor at a second higher pressure when the internal combustion engine operates at a temperature below a predetermined value.

22. Method of providing and regulating a mixture of fuel and air to a manifold of an internal combustion engine, comprising the steps of:

(a) providing a flow of fuel at a regulated pressure to a carburetor through an input fuel line;

(b) metering air and said fuel into a mixing chamber in the carburetor;

(c) maintaining a vacuum in said mixing chamber by passing said fuel and air through a control orifice in a stream flowing along a first axis;

(d) expanding said stream in an expansion chamber and thereby substantially decreasing the velocity of the stream along said axis;

(e) thereafter further expanding and directing said stream radially outward from said axis;

(f) thereafter introducing primary air into the stream along a 360° circular front and thereby mixing said fuel and air together in a mixture;

(g) thereafter directing said fuel and air mixture back into a stream flowing along said first axis into a manifold of an internal combustion engine; and (h) interrupting the flow of fuel to the carburetor when said internal combustion engine decelerates in engine speed at more than a predetermined rate.

23. A method as in claim 22 including the step of restoring the flow of fuel to the carburetor after first being interrupted and when the internal combustion engine is accelerated.

24. A method as in claim 22 including the step of restoring the flow of fuel to the carburetor after first being interrupted and before said engine dies.

25. A method as in claim 24 wherein the step of restoring the flow of fuel includes the steps of:

(a) measuring the rate of change of engine speed of the internal combustion engine and (b) restoring the flow of fuel if the rate of change decreases below a predetermined value.

26. A method as in claim 22 including the step of terminating the flow of fuel to the carburetor by de-energizing a valve in the fuel input line.

27. A method as in claim 26 wherein said terminating step includes the step of de-energizing an electrically operated solenoid valve in the fuel input line by de-energizing an ignition circuit of the internal combustion engine.

28. A carburetor for communicating an air-fuel mixture to an intake passage of an internal combustion engine comprising premixing chamber means for forming a first air-fuel mixture therein, fuel supply means for metering liquid fuel to said premixing chamber means, air supply means for metering air to said premixing chamber means, primary air intake means for communicating ambient air internally of said carburetor, throat means for receiving and mixing said first air-fuel mixture with ambient air from said primary air intake means to form a second air-fuel mixture for communication to the intake passage of said engine, expansion chamber means for receiving and expanding said first air-fuel mixture therein and for communicating and further expanding it into said throat means, and orifice means for metering said first air-fuel mixture from said premixing chamber means into said expansion chamber means.

29. In a carburetor for communicating an air-fuel mixture to an intake passage of an internal combustion engine, said carburetor comprising a mixing chamber adapted to form an air-fuel mixture therein, a primary air intake for communicating ambient air internally of said carburetor, and a throat intercommunicating between said mixing chamber and the intake passage of said engine, the improvement comprising means, including an orifice and an expansion chamber in series between said mixing chamber and said throat, for sequentially (1) receiving and expanding the air-fuel mixture from said mixing chamber, and (2) further expanding said air-fuel mixture into said throat to further mix ambient air from said primary intake therewith.

30. The carburetor of claim 29 wherein said means further expands said air-fuel mixture radially outwardly into said ambient air from said primary intake.

* * * * *